US008505685B1

(12) United States Patent
Rayfield et al.

(10) Patent No.: US 8,505,685 B1
(45) Date of Patent: Aug. 13, 2013

(54) ROOF SCAFFOLDING SYSTEM

(75) Inventors: Theodore A. Rayfield, Stone Lake, WI (US); William H. Mitchell, Stone Lake, WI (US)

(73) Assignee: Theodore A. Rayfield, Stone Lake, WI (US)

( * ) Notice: Subject to any disclaimer, the term of this patent is extended or adjusted under 35 U.S.C. 154(b) by 0 days.

(21) Appl. No.: 13/611,105

(22) Filed: Sep. 12, 2012

Related U.S. Application Data

(60) Provisional application No. 61/627,104, filed on Sep. 19, 2011.

(51) Int. Cl.
*E04G 3/22* (2006.01)

(52) U.S. Cl.
USPC ..... 182/45; 182/150; 33/648; 52/749.12

(58) Field of Classification Search
USPC ..... 33/648; 52/749.12; 182/45, 150
See application file for complete search history.

(56) References Cited

U.S. PATENT DOCUMENTS

| | | | | | |
|---|---|---|---|---|---|
| 253,816 | A | * | 2/1882 | Clark | 33/648 |
| 581,317 | A | * | 4/1897 | Vose | 182/45 |
| 846,784 | A | * | 3/1907 | Davis | 182/152 |
| 896,295 | A | * | 8/1908 | Haines | 182/196 |
| 988,808 | A | * | 4/1911 | Parris | 182/45 |
| 1,133,878 | A | * | 3/1915 | Nagel | 248/237 |
| 1,241,335 | A | * | 9/1917 | Boyd | 248/237 |
| 1,255,692 | A | * | 2/1918 | Bearden | 248/237 |
| 1,340,492 | A | * | 5/1920 | Melanson | 182/45 |
| 1,827,491 | A | * | 10/1931 | Spillman | 248/237 |
| 2,426,825 | A | * | 9/1947 | Geary | 248/237 |
| 2,496,556 | A | * | 2/1950 | Nelson | 248/237 |
| 3,292,734 | A | * | 12/1966 | Swanberg | 182/45 |
| 3,526,296 | A | * | 9/1970 | Stevens | 182/45 |
| 3,842,934 | A | | 10/1974 | Bartlett | |
| 4,785,606 | A | * | 11/1988 | Burton | 52/749.12 |
| 4,884,775 | A | * | 12/1989 | Fischer, Jr. | 248/237 |
| 5,113,971 | A | | 5/1992 | Violet | |
| 5,197,257 | A | * | 3/1993 | Nietling | 52/749.12 |
| 5,526,577 | A | * | 6/1996 | Nix | 33/648 |
| 5,624,006 | A | | 4/1997 | Richardson, Jr. | |
| 5,732,918 | A | | 3/1998 | Steele et al. | |
| 5,862,880 | A | | 1/1999 | Nelson et al. | |
| 5,908,083 | A | | 6/1999 | Hamilton | |
| 6,003,629 | A | | 12/1999 | Cloutier et al. | |
| 6,092,624 | A | * | 7/2000 | Slater | 182/45 |
| 6,220,390 | B1 | | 4/2001 | Pike | |
| 6,470,646 | B1 | | 10/2002 | Bryant | |
| 6,513,625 | B1 | * | 2/2003 | Gaskins | 182/45 |

(Continued)

*Primary Examiner* — Alvin Chin Shue
*Assistant Examiner* — Colleen M Chavchavadze
(74) *Attorney, Agent, or Firm* — Tipton L. Randall

(57) ABSTRACT

A roof scaffolding system includes a curved roof hook attached to a linear, metal membrane strip unit having connector rivets and nail holes. The metal strip includes double slot keyholes and attachment apertures that engage corresponding rivets on the roof hook. The opposite end of the metal strip includes connector rivets engaging double slot keyholes of an identical metal strip, extending opposite the roof hook. The nail holes allow attachment of wood spacers beneath the metal strips. Multiple strips are joined extending from the peak to the roof edge. A coupler connector covers the connection between joined metal strips preventing disconnection. Roof jacks include both nail slots and keyholes for attachment to the metal strips, as well as safety hooks for attachment of a lanyard from the scaffolding to workers. The roof jacks hold a plank that spans adjacent metal strips, the plank providing a place to stand.

10 Claims, 17 Drawing Sheets

(56) References Cited

U.S. PATENT DOCUMENTS

| | | | | |
|---|---|---|---|---|
| 6,732,835 | B1 | 5/2004 | Souto et al. | |
| 7,556,125 | B1 | 7/2009 | Blehm | |
| 7,568,671 | B2 | 8/2009 | Lallier | |
| 7,617,613 | B2 * | 11/2009 | Merryfield, Jr. | 33/648 |
| 8,186,479 | B2 * | 5/2012 | Vieira | 182/45 |
| 2007/0034449 | A1 * | 2/2007 | Leendertse | 182/45 |
| 2007/0062761 | A1 * | 3/2007 | Megna et al. | 182/45 |
| 2012/0061178 | A1 * | 3/2012 | Mathieson | 182/45 |
| 2012/0211303 | A1 * | 8/2012 | Parquette | 182/45 |

* cited by examiner

ROOF SCAFFOLDING SYSTEM

CROSS-REFERENCE TO RELATED APPLICATIONS, IF ANY

This application claims the benefit under 35 U.S.C. §119 (e) of provisional application Ser. No. 61/627,104, filed 19 Sep., 2011. Application Ser. No. 61/627,104 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to scaffolding and, more particularly, to roof scaffolding that can be attached without standing on the surface of the roof itself and, most particularly, to roof scaffolding that does not interfere with placement and attachment of roofing materials on the roof with the scaffolding in position.

2. Background Information

Many patents have been granted for devices that are used as scaffolding for working on a pitched roof. Bartlett, in U.S. Pat. No. 3,842,934, describes a plurality of elongated load supporting members adapted to be supported in a spaced-apart relationship on a sloping roof. A hook is attached to the elongated load supporting members to extend over the gable of the sloping roof and contact the opposite sloping roof. A load supporting carriage rides on each of the elongated load supporting members and contains a means to incrementally advance the load supporting carriages on the elongated load supporting members. An additional elongated load supporting member has one portion of the member residing on one load supporting carriage and another portion of the load supporting member residing on another load supporting carriage. The apparatus, when used according to the method of this invention, provides a safe and economical method for laying roofing materials on a sloping roof.

In U.S. Pat. No. 5,113,971, Violet discloses an adjustable roofing jack for securing a scaffold of a selected size for roofers to prevent falls and other dangers associated with working on an inclined surface, especially high-pitched roofs. The adjustable roofing jack includes a frame for engaging the surface of the roof. The frame includes an extended portion for engaging one side of a scaffold board. An opening is defined by the extended portion for the receipt of a nail, screw or other conventional fastener prevents the scaffold board from rotating axially. Slotted openings are defined by the frame for receiving at least one selected fastener to secure the adjustable roofing jack to the roof. A scaffold support is attached to the frame for supporting a scaffold board of a selected width. An adjuster is provided for altering the effective width of the scaffold support. The adjuster includes an angled member and a fastener for securing the angled member to the scaffold support. An opening is defined by the frame for storing the adjuster when not deployed.

Richardson Jr., in U.S. Pat. No. 5,624,006, describes a support apparatus for scaling and working on an inclined roof made up of at least one ladder having a pair of ridge hooks to engage the roof ridge. A rotatable support frame is secured to the ladder, and a pivotally mounted platform supports workers and materials. The support frame includes a pair of horizontal members, a pair of vertical legs, and a cross brace assembly, which are attached to one another by a mechanism adapted to allow rotation of the legs of at least 180 degrees around the outside of the horizontal member from an axle formed by the cross brace. The ladder includes hollow rungs and an opening in each rail, forming a tubular passage. Each of the legs has a tube horizontally attached to each end, forming an opening for alignment with the ladder openings, such that a securing rod can be passed through the passage. The rod acts as a spindle upon which the legs rest to the outbound sides of the ladder. The cross brace assembly is a generally Z-shaped configuration made of a pair of cross braces, having sliding members for vertical adjustment of the support frame to variously inclined roofs. The platform is pivotally mounted to each of the horizontal members by a trunnion for easy access to the rungs of the ladder below. A chimney-arm attachment is provided for partially encircling a chimney for added or sole support of the support apparatus from an existing chimney.

U.S. Pat. No. 5,732,918 by Steele et al. disclose a roof catchboard bracket for securing a catchboard to a roof, preferably formed from a plastic material. The device includes an L-shaped bracket having a first leg, removably secured to a roof, and a second leg, removably secured to a catchboard. An integrally formed brace portion extends intermediate the first and second legs for bracing the second leg against the first leg. Other features include a provision for nesting a plurality of such brackets one on top of the other, and pry chamfers, which allow the brackets to be readily removed after nailing to a roof surface.

In U.S. Pat. No. 5,862,880, Nelson et al. describe a roof scaffolding system for use on a pitched roof that can be moved both longitudinally and laterally. The roof scaffolding system includes a peak anchor having a carrying assembly connected atop thereof, the peak anchor being adapted for connecting to a pitched roof. A side rail assembly having a base member, a top member and a load support member supports an elongated scaffold member. The load support member interconnects the base member and the top member. An elongated flexible member operationally connects the side rail assembly and the peak anchor in a manner such that the side rail assembly may be moved longitudinally and laterally upon a roof. The roof scaffolding system may include a cross rail member connected between the side rail assemblies to serve as a safety rail for a user. The roof scaffolding system may further include a net connected between the side rail assemblies to prevent objects from falling from the work area.

Hamilton, in U.S. Pat. No. 5,908,083, describes an improved roof worker support apparatus for placement on slanted roof structures with varying peak angles. The apparatus includes a pair of peak-adjustable elongated assemblies, independently deployable on the roof structure in spaced substantially parallel positions extending up the roof. Each includes at least one elongated crosspiece, removably supportable across the elongate assemblies. The elongated assemblies include an elongated roof-contact member, an overpeak member, an adjustment member between the overpeak member and the roof-contact member and adjustable to set the elongated roof-contact member and overpeak member at a desired angle to accommodate roof peak angles. At least one crosspiece-support member is affixed to the elongate roof-contact member. Highly preferred embodiments include certain extension members.

U.S. Pat. No. 6,003,629 by Cloutier et al. discloses a roofer's safety brace unit, consisting of a pair of main frame track components, an extension arm, a pivotably attached support arm equipped with a rubberized foot pad at one end thereof and a running wheel at the other end thereof. The unit is placeable upon a roof by virtue of the function of a plurality of chair-shaped lateral support units, equipped with rubberized foot pads attached to plank holding brackets attached to the main frame track components or extension arm. One of the brackets is further equipped with a pivotable plank bar such that when a duplicate pair of such safety brace units is utilized by a roofer, planking suitable to safely supporting the weight of a roofer working on a roof is readily and dependably held fast in place.

Pike, in U.S. Pat. No. 6,220,399, describes a roof scaffolding comprising two or more elongate support members or tracks spaced above an inclined roof surface, with the support members having upwardly open channels positioned in spaced, generally parallel relation of a roof surface. A hook at the upper end of each channel engages a roof ridge or ridge vent for holding each channel in place. Each channel receives a sliding brace held in selected position along the channel by a block plate. A roofer's plank spans the roof between sliding braces supporting a roofer in the task of laying roof materials. Movable spacers resist deflection of the support members intermediate their ends and, in particular, to resist deflection under a workman's weight on the scaffolding. The support members are lightweight and easily placed in position by hooking one end over the roof ridge or into a ridge vent. The support members include a fixed end spacer for spacing the supports from the roof surface. Each sliding brace is moved into position on a support member and held by a block plate. Then a platform or plank spans the brace members providing a foothold for the roofer. The sliding braces can be selectively positioned in their channels along the support members as the roof installation proceeds along the roof surface. Moveable spacers are positioned under the support members in the vicinity of the workman to maintain roof spacing so as to permit laying of materials under the supports at all positions of the scaffolding on the inclined roof.

U.S. Pat. No. 6,470,646 by Bryant discloses a roof scaffolding system that includes a support assembly disposed on one inclined surface of a roof extending to a peak of the roof and attached to an opposite inclined surface of the roof near the peak thereof. A roof jack rests on the one inclined surface of the roof straddling and connected to the support assembly. A valley support assembly positioned on a valley of the roof along one side of the one inclined surface and extending to the peak of the roof and attached to the opposite inclined surface of the roof near the peak thereof. A valley jack straddles the valley of the roof and valley support assembly and is anchored to the valley support assembly. The roof and valley jacks are spaced apart so as to support a flat board extending there between.

In U.S. Pat. No. 6,732,835, Souto et al. describe a roofing stage for pitched roofs that includes first and second elongated tracks disposed generally parallel to one another. A base bracket attaches a lower end of each track to roof beams. Padded feet extend from a bottom surface of the tracks for contact with the roof. Hooks extend from upper ends of the first and second brackets for attachment to an apex of the roof. A carriage bracket is slidably attached to each track and has a foot support extending therefrom. A platform bracket is slidably attached to each of the first and second tracks above the carriage brackets for supporting a platform there between. The movable brackets enable the roofer to properly position himself and necessary tools and supplies.

Blehm, in U.S. Pat. No. 7,556,125, describes a ladder ridge anchor device and system incorporating mechanisms for attaching a ladder to a roof ridge anchor to secure a ladder over the roof ridge of a building. The ladder ridge anchor device allows the user to easily adjust the position of the ladder relative to the roof ridge anchor to facilitate work on and access to the roof or other building areas. Stabilizing components help prevent lateral movement of the ladder with respect to the attached ridge anchor, and extension components elevate the ladder and roof ridge anchor off the surface of the roof.

U.S. Pat. No. 7,568,671 by Lallier discloses a roofing bracket, wherein use of a plurality of the roofing brackets provides a generally horizontal working surface on an inclined standing seam roofing panel. The roofing bracket comprises a first and second section, each section defining a base and an upright extending from the base. A clamping mechanism securely and removeably fastens the first section upright and the second section upright to one another and abutting opposite sides of the standing seam. The roofing brackets further define a retaining element for engaging and retaining a plank suitable for providing a generally horizontal working surface.

Applicants have devised a roof scaffolding system that overcomes many of the shortcomings of the devices described in these patents.

SUMMARY OF THE INVENTION

The invention is directed to a roof scaffolding system that can be secured to the roof without standing on the surface of the roof. The scaffolding system includes a roof hook attached to one end of a linear, metal membrane strip unit. The roof hook is curved to engage the peak of a roof without fasteners. The metal strip unit includes upward extending rivets at 12 inch intervals and nail holes at 2 inch intervals. One end of the metal strip unit includes a plurality of double slot keyholes that engage corresponding rivets on the roof hook. The opposite end of the metal strip unit includes male rivets positioned to engage the plurality of double slot keyholes of a second identical metal strip unit, extending opposite the roof hook. The nail holes allow attachment of wood spacers beneath the metal strip units to elevate the metal membrane strip units above the roof surface. Thus, multiple strip units can be joined to extend from the roof peak to the bottom edge of the roof. A hollow, coupler connector fits over the connection between joined metal strip units to prevent unwanted disconnection of the rivets and slot keyholes. The coupler connector includes exterior, spring-biased, hinged, tongue locks to maintain the joined metal strip units in place. The tongue locks can be manually unlocked to separate the metal strip units when needed. Roof jacks include both nail slots and keyholes for attachment to the metal strip units, as well as safety hooks, for attachment of a lanyard from the scaffolding to a worker. The roof jacks have a holder for a plank that spans adjacent metal strip units, and the planks provide the workers a platform on which to stand. In addition, an angle iron foot bar having perpendicular surfaces, each with multiple key slots therein, is attached between rivets of adjacent metal strip units for an additional platform on which to stand.

In an alternative embodiment of the invention, the roof hook comprises a multiple hinge device with rivets that engage a hinge bracket member that attaches to a spacer board. A metal strip unit secured atop the spacer board engages a second set of rivets on the extension. The multiple hinge device includes nail holes in all sections for securing the hinge device to the roof peak. The multiple hinge device also has multiple rings or tabs for attaching a safety lanyard from a worker. A pair of latch plates is used to connect spacer boards end to end, such that metal strip units secured atop the boards extend the full rise of the roof. Again, an angle iron foot bar having perpendicular surfaces, each with multiple key slots therein, is attached between rivets of adjacent metal strip units for an additional platform on which to stand. A plank may be secured to the foot bar to provide secure footing for workers on the roof.

DESCRIPTION OF THE EMBODIMENTS

Nomenclature

Figure 1:
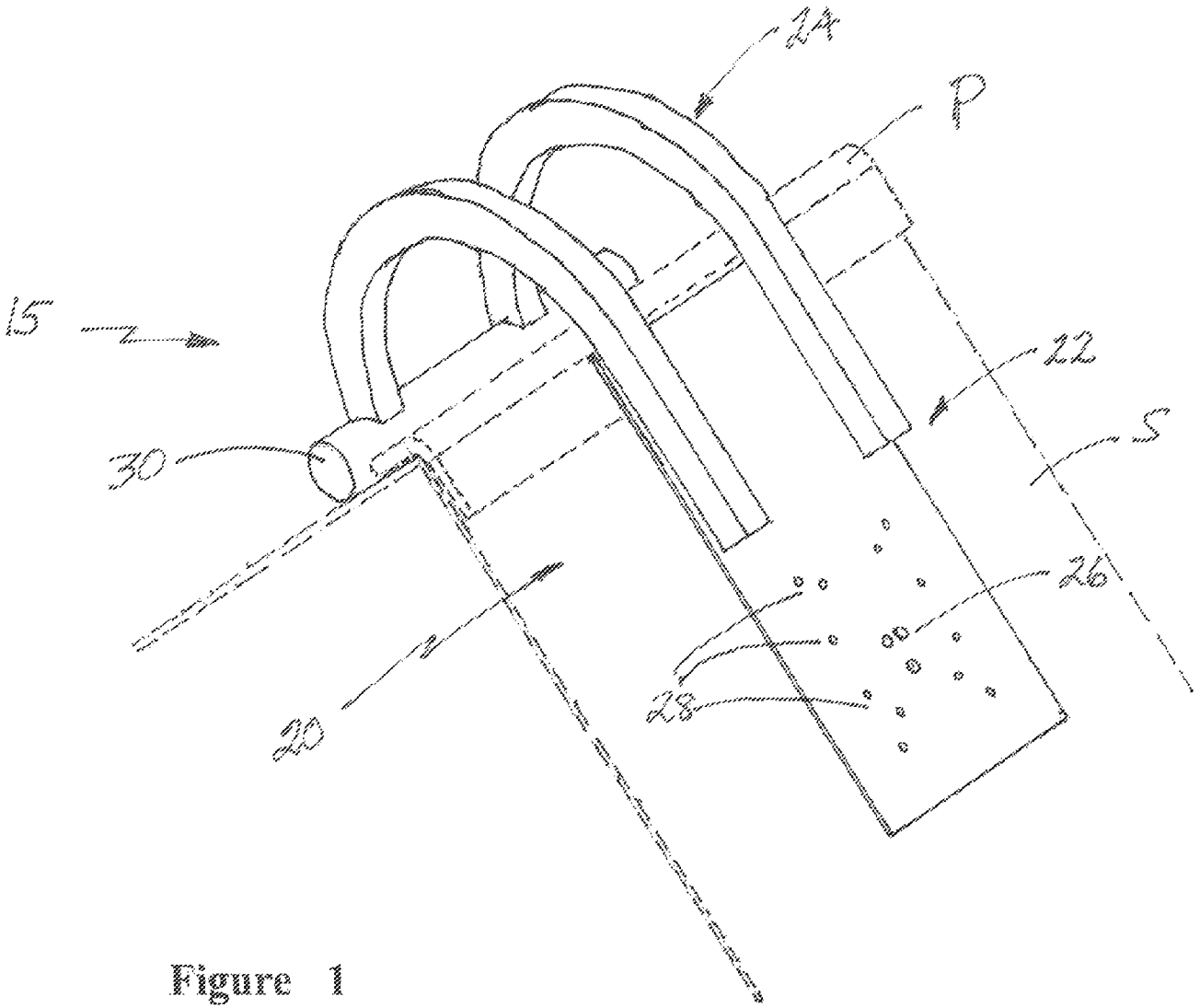
FIG. 1 is a perspective view of the roof hook member of the present invention with no supporting attachments.

| | |
|---|---|
| 10 | Roof Scaffolding System |
| 15 | Roof Hook Member |
| 20 | J-Shaped Member |
| 22 | Linear Section of Roof Hook Member |
| 24 | Curved Hook End of Roof Hook Member |
| 25 | Pivoting Joints of Curved Hook End |

-continued

| | |
|---|---|
| 26 | Connector Studs |
| 27 | Locking Bolts of Pivoting Joints |
| 28 | Attachment Apertures |
| 30 | Cylindrical Section of Roof Hook Member |
| 35 | Spacer Block Member |
| 40 | Linear Metal Membrane Strip Unit |
| 42 | Attachment Apertures |
| 44 | First End of Strip Unit |
| 46 | Keyhole Apertures |
| 48 | Connector Rivets |
| 50 | Second End of Strip Unit |
| 52 | Attachment Apertures |
| 54 | Connector Rivets |
| 60 | Hollow Coupler Connector Member |
| 62 | Hollow Body Portion |
| 64 | Spring-Loaded Tabs |
| 66 | Double Keyhole Apertures |
| 70 | Roof Jack Member |
| 72 | Leg Section of Roof Jack Member |
| 74 | Curved Section of Roof Jack Member |
| 76 | Keyhole Apertures |
| 77 | Nail Slots |
| 78 | Attachment Apertures |
| 79 | Safety Hooks |
| 80 | Foot Bar Member |
| 82 | Perpendicular Walls |
| 84 | Keyhole Apertures |
| 86 | Attachment Apertures |
| 88 | Safety Hooks |
| 90 | Rolled Roofing Dispenser |
| 91 | Rectangular Container |
| 92 | Top Wall |
| 93 | Bottom Wall |
| 94 | End Walls |
| 95 | Open Sides of Container |
| 96 | Cylindrical Support within Container |
| 97 | Keyhole Apertures |
| 98a | Hinges of Top Wall |
| 98b | Latch of Top Wall |
| 98c | Hinge of Bottom Wall |
| 99 | Handles of Top Wall |
| 100 | Roof Scaffolding System |
| 115 | Roof Hook Member |
| 120 | Hinge Device |
| 122 | Outer Pair of Metal Plates |
| 124 | Inner Pair of Metal Plates |
| 126 | Common Shaft of Hinge Device |
| 128 | Attachment Apertures |
| 130 | Connector Rivets |
| 132 | Safety Hook |
| 134 | Safety Hook |
| 135 | Elongated Wood Block Member |
| 140 | Linear Metal Membrane Strip Unit |
| 142 | Attachment Apertures |
| 144 | First End of Strip Unit |
| 146 | Keyhole Apertures |
| 148 | Connector Rivets |
| 150 | Second End of Strip Unit |
| 160 | Hinge Bracket Member |
| 162 | Rectangular Body |
| 164 | Open End of Rectangular Body |
| 166 | Flange Section |
| 167 | Keyhole Apertures |
| 168 | Nail Slots |
| 169 | Connector Rivets |
| 170 | Latch Plate Members |
| P | Peak of Roof |
| S | Roof Surface |
| F | Roofing Felt |

Construction

The invention is a roof scaffolding system that can be secured to the roof without standing on the surface of the roof. The scaffolding system includes a roof hook attached to one end of a linear, metal membrane strip unit. The roof hook is curved to engage the peak of a roof without fasteners. The metal strip unit includes upward extending rivets at 12 inch intervals and nail holes at 2 inch intervals. One end of the metal strip unit includes a plurality of double slot keyholes that engage corresponding rivets on the roof hook. The opposite end of the metal strip unit includes male rivets positioned to engage the plurality of double slot keyholes of a second identical metal strip unit, extending opposite the roof hook. The nail holes allow attachment of wood spacers beneath the metal strip units to elevate the metal membrane strip units above the roof surface. Thus, multiple strip units can be joined to extend from the roof peak to the bottom edge of the roof. A hollow, coupler connector fits over the connection between joined metal strip units to prevent unwanted disconnection of the rivets and slot keyholes. The coupler connector includes exterior, spring-biased, hinged, tongue locks to maintain the joined metal strip units in place. The tongue locks can be manually unlocked to separate the metal strip units when needed. Roof jacks include both nail slots and keyholes for attachment to the metal strip units, as well as safety hooks, for attachment of a lanyard from the scaffolding to a worker. The roof jacks have a holder for a plank that spans adjacent metal strip units, and the planks provide the workers a platform on which to stand. In addition, an angle iron foot bar having perpendicular surfaces, each with multiple key slots therein, is attached between rivets of adjacent metal strip units for an additional platform on which to stand.

In an alternative embodiment of the invention, the roof hook comprises a multiple hinge device with rivets that engage a hinge bracket member that attaches to a spacer board. A metal strip unit secured atop the spacer board engages a second set of rivets on the extension. The multiple hinge device includes nail holes in all sections for securing the hinge device to the roof peak. The multiple hinge device also has multiple rings or tabs for attaching a safety lanyard from a worker. A pair of latch plates is used to connect spacer boards end to end, such that metal strip units secured atop the boards extend the full rise of the roof. Again, an angle iron foot bar having perpendicular surfaces, each with multiple key slots therein, is attached between rivets of adjacent metal strip units for an additional platform on which to stand. A plank may be secured to the foot bar to provide secure footing for workers on the roof.

Figure 2:
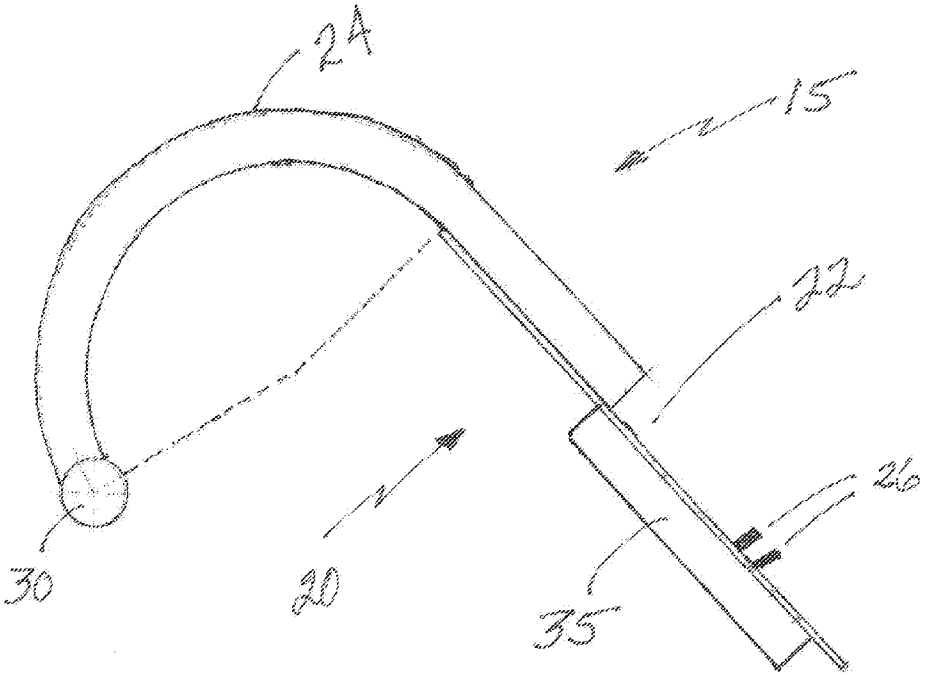
FIG. 2 is a side view of the roof hook member of the present invention with no supporting attachments.

Referring now to FIGS. 1-9, a first embodiment of the roof scaffolding system 10 for temporary attachment to a roof surface is illustrated. FIGS. 1 and 2 show a roof hook member 15 that is removably attached to a first end 44 a first linear metal membrane strip unit 40. The roof hook member 15 is adapted for engagement with the peak P of the roof with the first linear metal membrane strip unit 40 extending down the roof. The roof hook member 15 includes a J-shaped member 20 with a linear section 22 secured to a curved hook end 24. The linear section 22 comprises a flat plate with a plurality of connector studs 26 extending outwardly there from. The connector studs 26 engage the first end 44 of the first linear metal membrane strip unit 40. A spacer block member 35 is attached to the linear section 22 of the J-shaped member 20 opposite the connector studs 26 by fasteners extending through attachment apertures 28 in the flat plate linear section 22. The curved hook end 24 has a cylindrical section 30 positioned opposite the linear section 22 with the cylindrical section 30 adapted for contacting the roof surface S, as illustrated in FIG. 1. Thus, the roof hook member 15 engages the peak P of the roof in the orientation shown in FIG. 1, and disengages the peak P of the roof by rotating the roof hook member 15 180 degrees.

Figure 3:
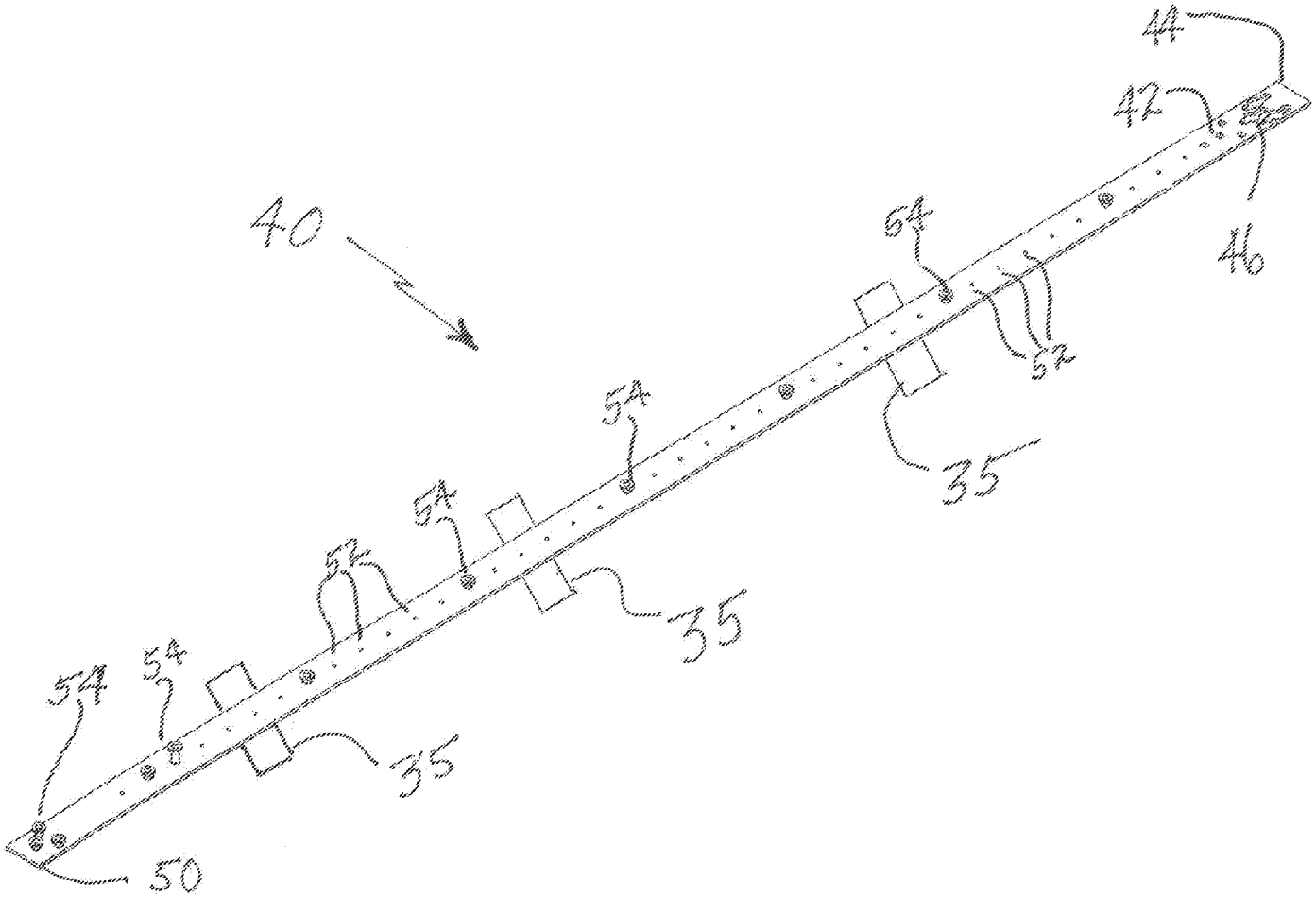
FIG. 3 is a perspective view of the linear metal membrane strip unit of the present invention with spacer block members attached.
Figure 4B:
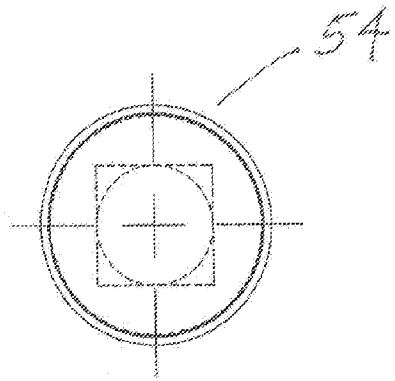
FIG. 4*b* is a top view of the connector rivets of the linear metal membrane strip units of the present invention.
Figure 4A:
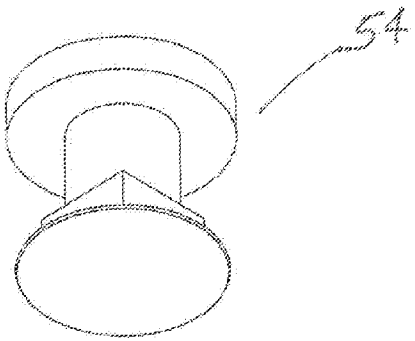
FIG. 4*a* is a perspective view of the connector rivets of the linear metal membrane strip units of the present invention.

Referring now to FIG. 3, the linear metal membrane strip unit 40 includes a plurality of attachment apertures 42 at the first end 44 thereof. The apertures 42 are positioned to engage the plurality of connector studs 26 extending outwardly from the roof hook member 15. A plurality of keyhole apertures 46 are also present at the first end 44 of the strip unit 40, adjacent the attachment apertures 42. A like plurality of connector rivets 54 are positioned at the second end 50 of the strip unit 40 for engagement with corresponding keyhole apertures 46 in the first end 44 of another linear metal membrane strip unit 40, thereby providing facile connection and disconnection of any number of linear metal membrane strip units 40. In addition, a plurality of apertures 52 are positioned at selected locations along the length of the linear metal membrane strip unit 40. Likewise, a plurality of connector rivets 54 extend at spaced intervals from a common side of the linear metal membrane strip unit 40. Detailed views of a connector rivet 54 are shown in FIGS. 4*a* and 4*b*. In order to align the linear metal membrane strip unit 40 with the roof hook member 15, a plurality of spacer block members 35 are rigidly attached to a common side of the linear metal membrane strip unit 40 using fasteners, such as nails or screws (not shown), inserted through selected attachment apertures 52 positioned along the linear metal membrane strip unit 40.

In order to extend the roof scaffolding system 10 further down the roof, a second linear metal membrane strip unit 40, identical to the first linear metal membrane strip unit 40 is employed. The second linear metal membrane strip unit 40 likewise includes a plurality of attachment apertures 52, a plurality of keyhole apertures 46, and a plurality of connector rivets 54, as described above, as well as spacer block members 35 for proper alignment. The second strip unit 40 is removably attached at a first end 44 to a second end 50 of the first linear metal membrane strip unit 40 opposite the roof hook member 15.

Figure 5:
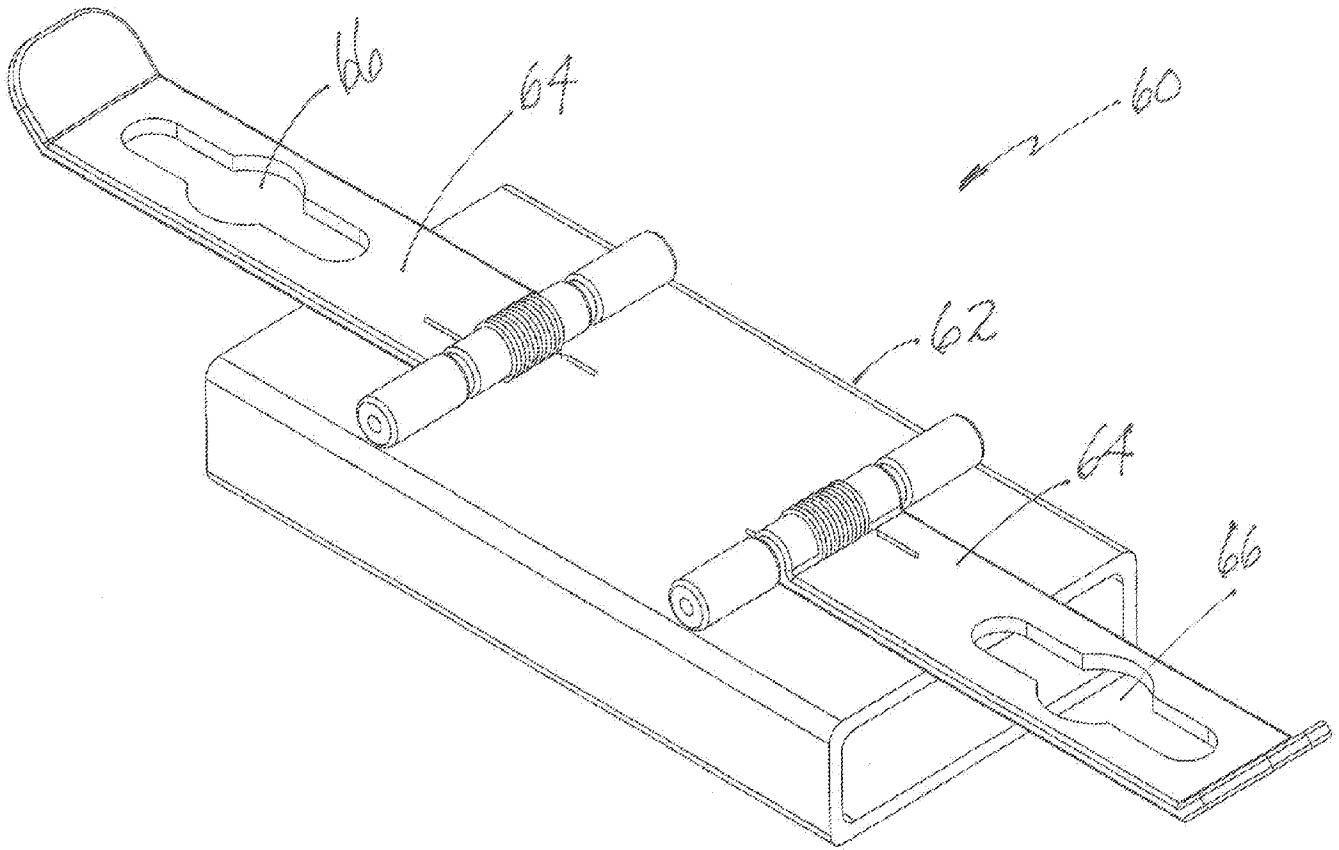
FIG. 5 is an enlarged, perspective view of the coupler connector member of the present invention with the hinges and the heavy duty springs that hold the hinged tabs in place.
Figure 6:
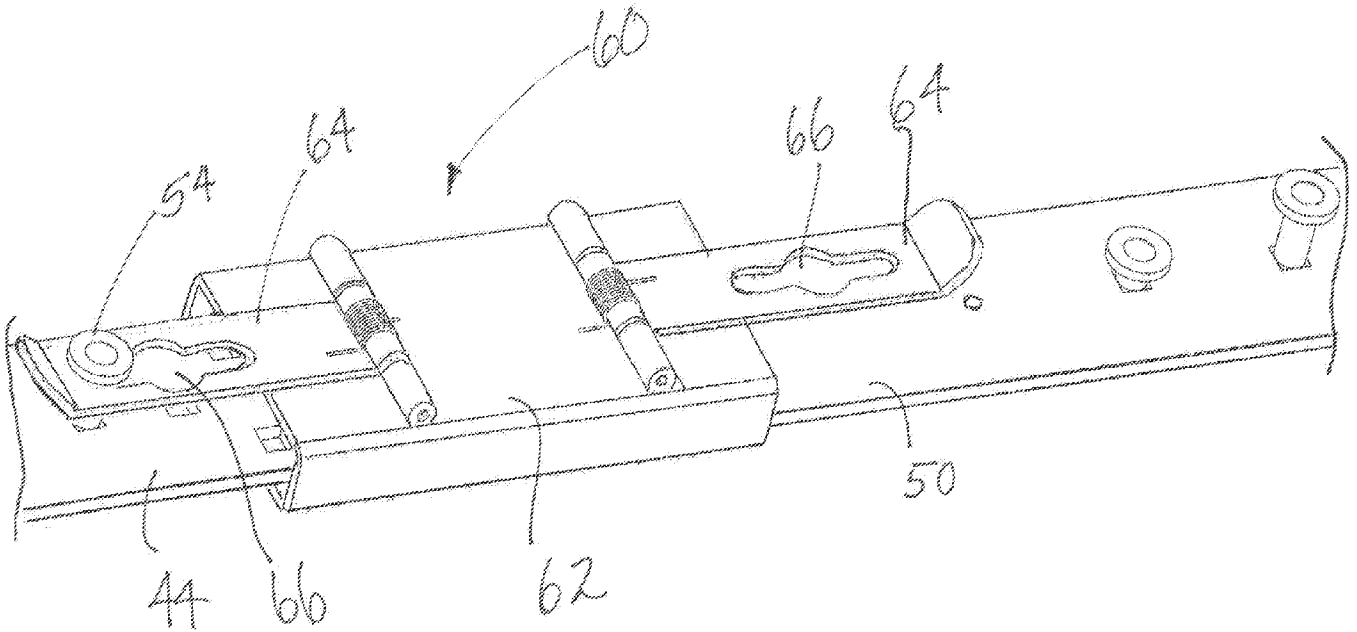
FIG. 6 is a perspective view of the coupler connector member of the present invention with the hinged tabs engaging joined ends of linear metal membrane strip units.

To secure the connection, a hollow coupler connector member 60 encircles and locks connected ends of adjacent linear metal membrane strip units 40. The hollow coupler connector member 60 includes a hollow body portion 62 and a pair of spring-loaded tabs 64, one at each end of the hollow body portion 62, as shown in FIG. 5. Each tab 64 is mounted on a spring-biased shaft, and extends beyond one end of the hollow body portion 62. Each tab 64 includes a double keyhole aperture 66 adapted for engaging a connector rivet 54 of one linear metal membrane strip unit 40 for locking the hollow coupler connector member 60 over joined ends of adjacent linear metal membrane strip units 40, as illustrated in FIG. 6. The hollow coupler connector member 60 is easily disengaged from each linear metal membrane strip unit 40 by a worker, and is stored on one of the linear metal membrane strip units 40 interior an end thereof.

Figure 7:
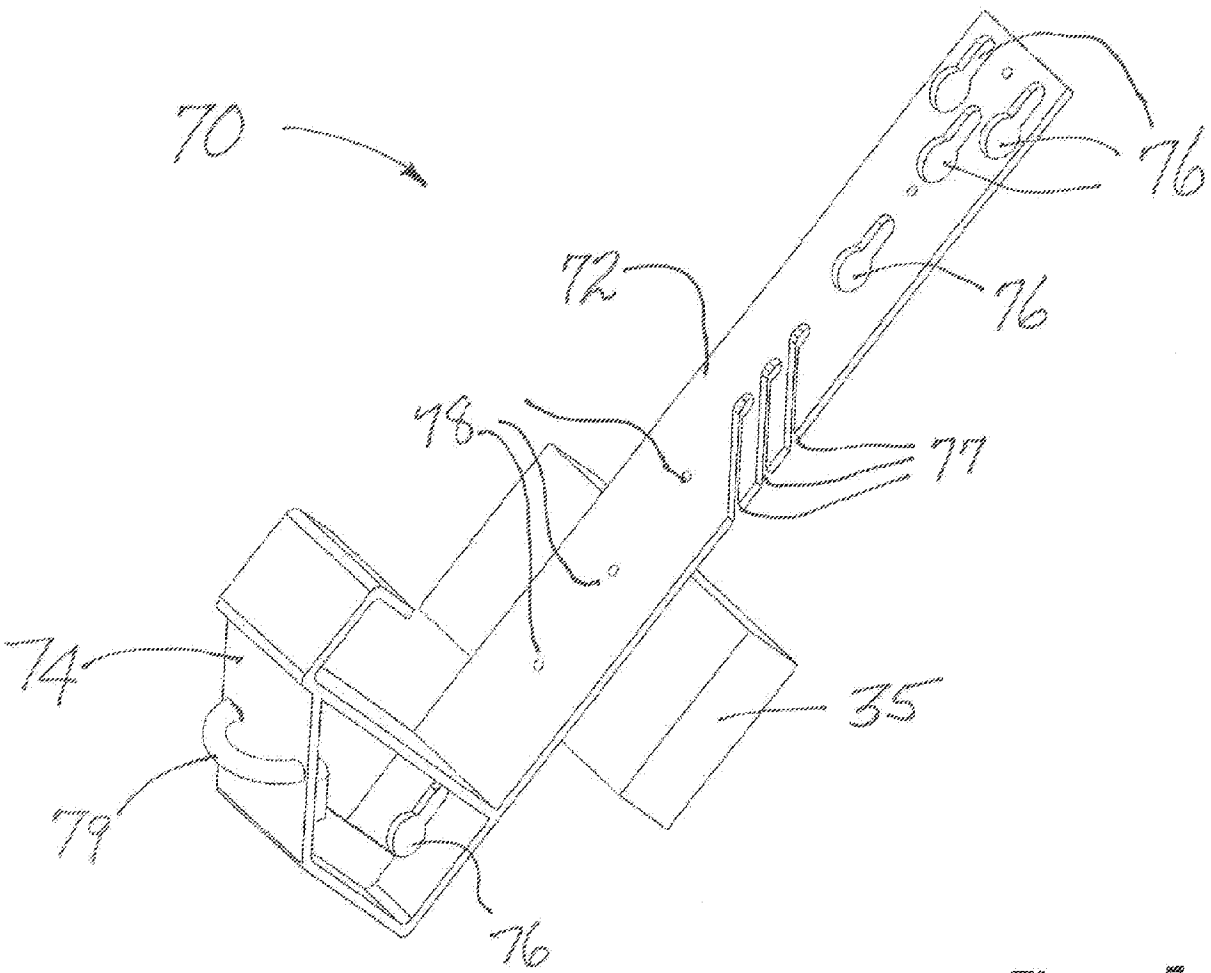
FIG. 7 is a perspective view of the roof jack member containing the keyholes, nail slots, nail holes and safety hook of the present invention.
Figure 8:
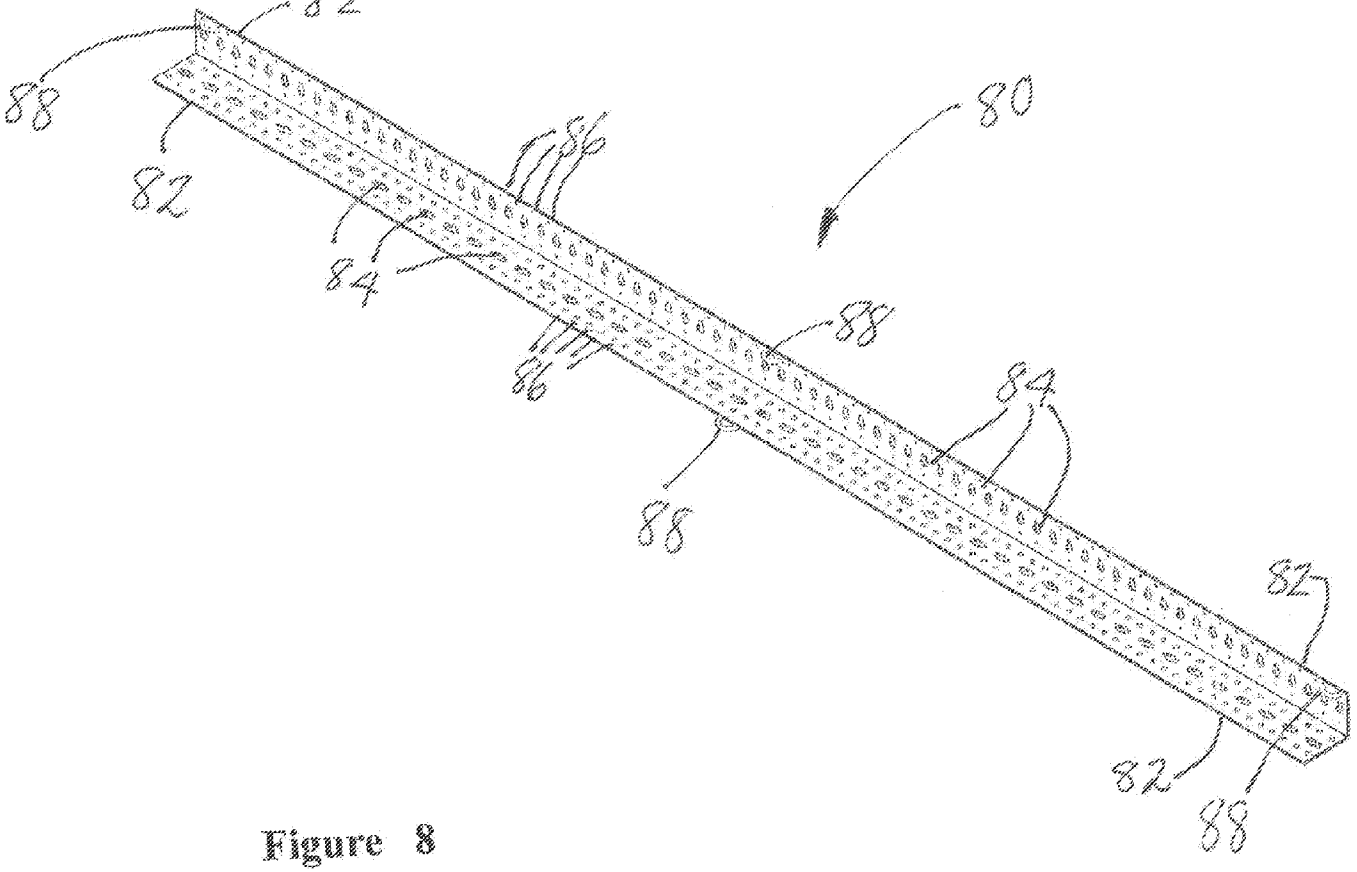
FIG. 8 is a perspective view of the "L" shaped a foot bar member of the present invention.
Figure 9A:
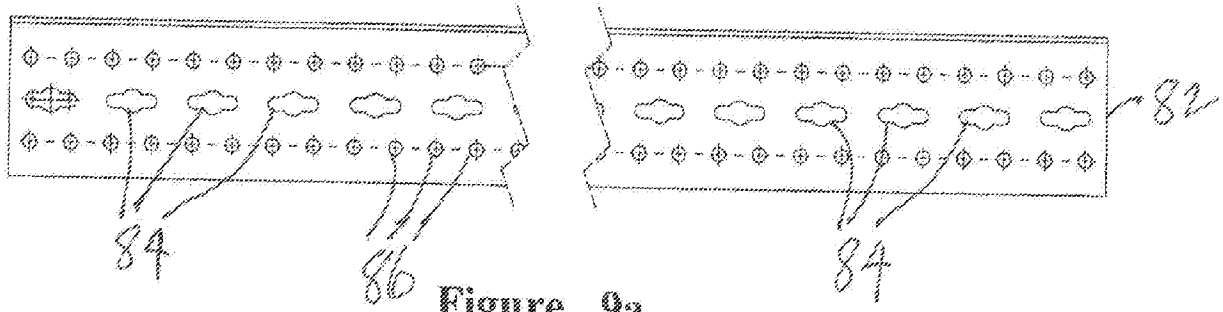
FIG. 9*a* shows a top view of the foot bar member of FIG. 8 of the present invention.
Figure 9B:
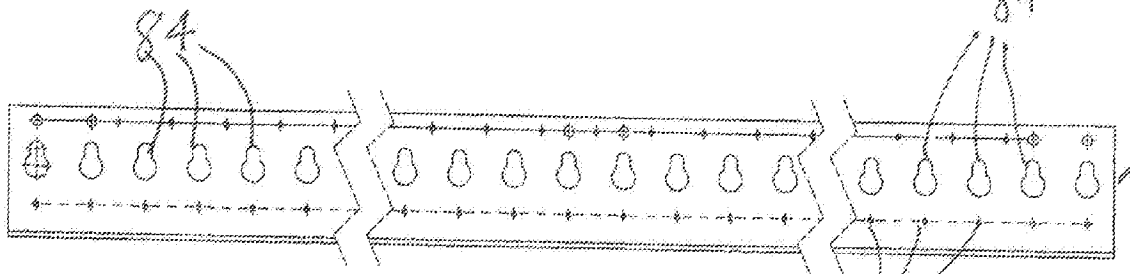
FIG. 9*b* shows a front view of the foot bar member of FIG. 8 of the present invention.
Figure 9C:
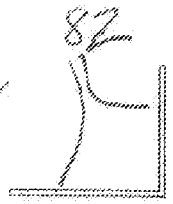
FIG. 9*c* shows an end view of the foot bar member of FIG. 8 of the present invention.
Figure 10B:
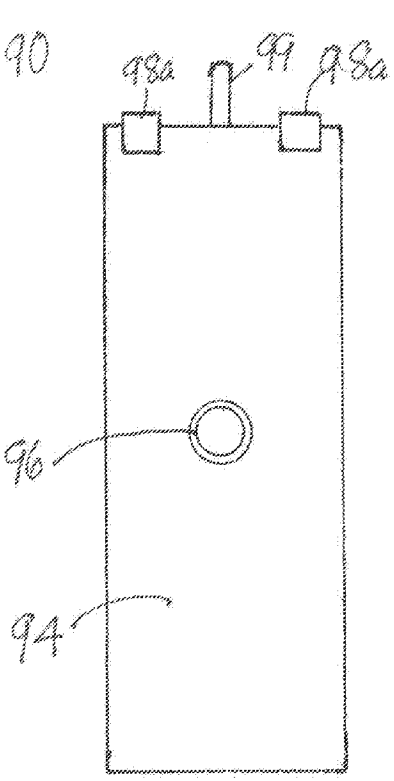
FIG. 10*b* is an end view of the rolled roofing dispenser of the present invention.
Figure 10A:
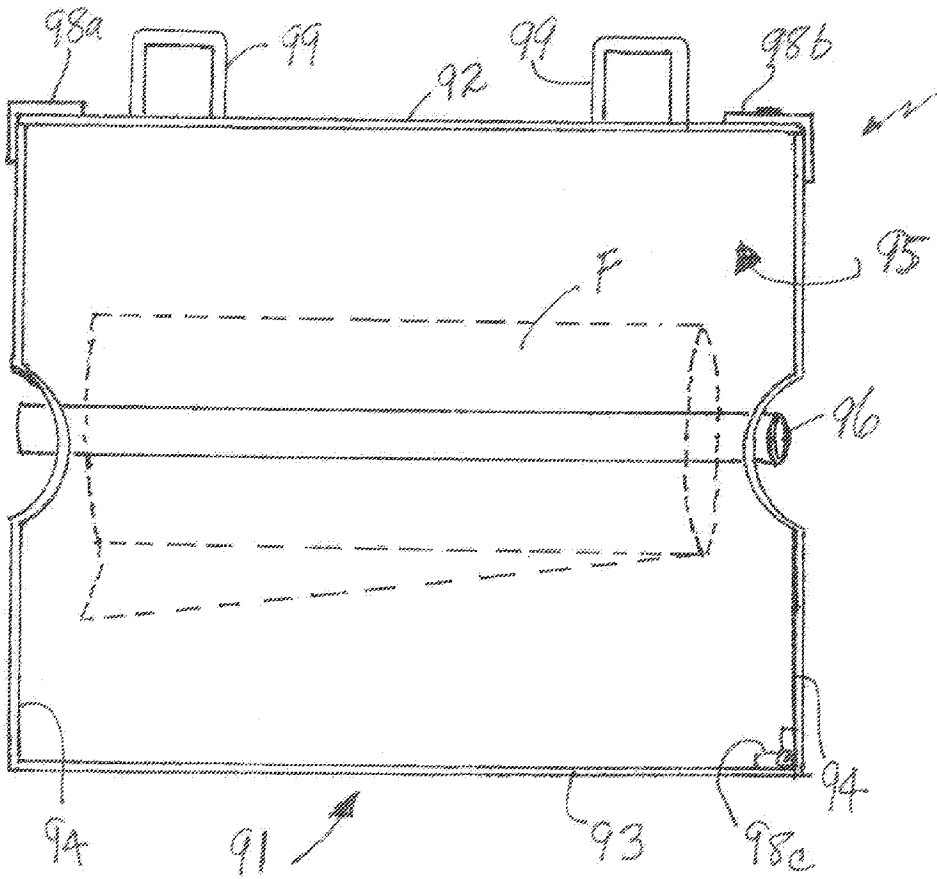
FIG. 10*a* is a side view of the rolled roofing dispenser of the present invention.
Figure 10C:
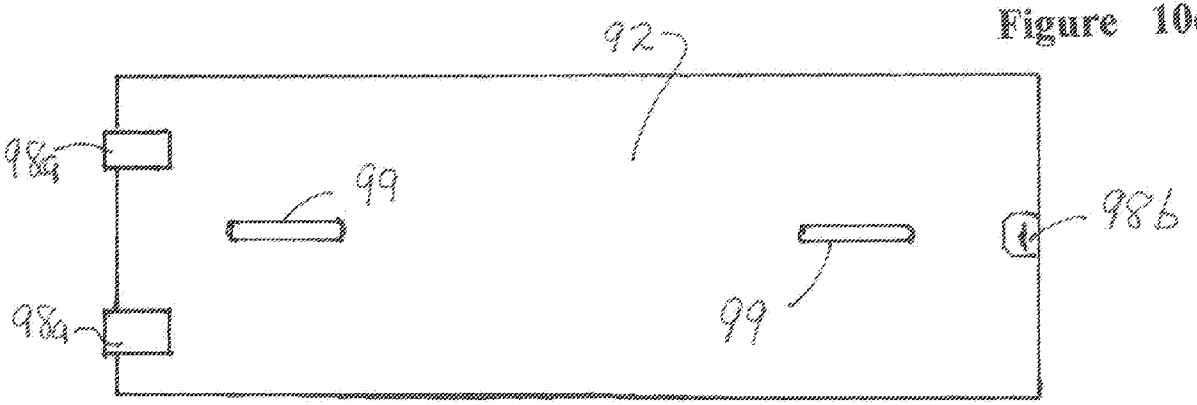
FIG. 10*c* is a top view of the rolled roofing dispenser of the present invention.
Figure 10D:
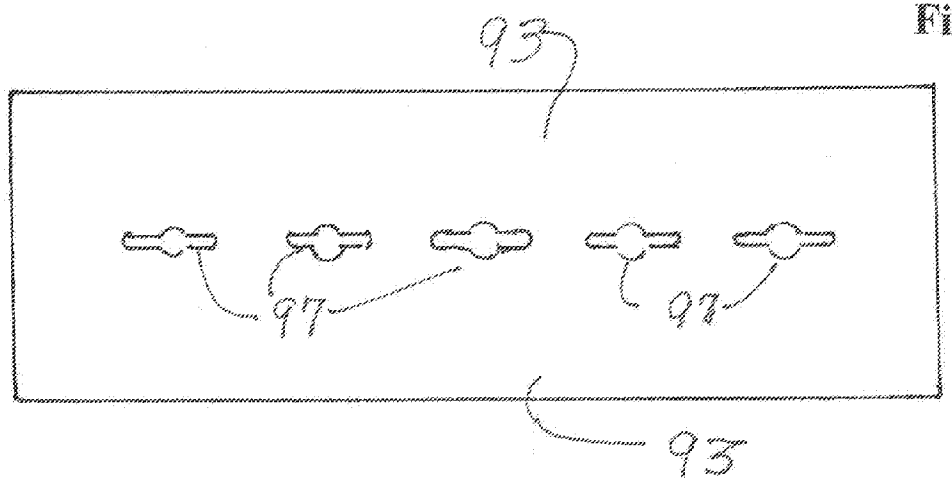
FIG. 10*d* is a bottom view of the rolled roofing dispenser of the present invention.

A roof jack member 70, shown in FIG. 7, is removably connected to a second end 50 of one linear metal membrane strip unit 40. The roof jack member 70 is adapted for securing a foot board perpendicular to the connected linear metal membrane strip unit 40. The roof jack member 70 is J-shaped with one longer leg section 72 secured to a curved end section 74. The longer leg section 72 includes a plurality of keyhole apertures 76 for securing the roof jack member 70 to the second end 50 of a linear metal membrane strip unit 40 as described earlier. The longer leg section 72 includes a plurality of nail slots 77 and nail apertures 78 therein for fastening a spacer block member 35 thereto, for alignment purposes. The curved end section 74 is adapted for securing a foot board perpendicular thereto, and a safety hook 79 is secured to the roof jack member 70. The safety hook 86 is adapted for engagement with a safety lanyard attached to a workman.

In common practice, a pair of the above-described roof scaffolding systems 10 is portioned in parallel extending down from the peak P of the roof. A foot board extending between the two roof scaffolding systems 10 is supported at each end of each assembly by a roof jack member 70 to provide support for the feet of the workers. The spacer block members 35 provide clearance beneath each roof scaffolding system 10 so that roofing material can be continuously applied to the roof surface without interference by the scaffolding systems 10. As the roofing material is applied from the bottom edge of the roof to the peak P, linear metal membrane strip units 40 are removed and the roof jack members 70 attached to the second end 50 of the remaining linear metal membrane strip units 40.

In a further embodiment of the invention, a foot bar member 80 is added to the pair of roof scaffolding systems 10. As illustrated in FIGS. 8 and 9*a*-9*c*, the foot bar member 80 comprises a linear angle iron with perpendicular walls 82, each wall 82 including a plurality of keyhole slots 84 adapted for engagement with connector rivets 54 extending at spaced intervals from each linear metal membrane strip unit 40. One wall 82 contains single keyhole slots 84 and the other wall 82 contains double keyhole slots 84 to reduce the weight of the foot bar member 80. In addition, each wall 82 contains attachment apertures 86 for fastening a foot board to either wall 82. Further, a plurality of safety hooks 88 are secured to the foot bar member 80, The safety hooks 88 adapted for engagement with a safety lanyard attached to a workman.

In yet a further embodiment of the invention, a rolled roofing dispenser 90, shown in FIGS. 10*a*-10*d*, is easily secured to or removed from the linear metal membrane strip units 40. The rolled roofing dispenser 90 comprises a rectangular container 91 with solid top wall 92, bottom wall 93, opposed end walls 94, and opposed open sides 95. A cylindrical support 96 is permanently mounted to one of the opposed end walls 94 and slidably supported by the opposite end wall 94. The support 96 is adapted for holding a roll of roofing felt F. For example, the cylindrical support 96 is slidably mounted in an aperture in one end wall 94, which is attached by a hinge 98*c* to the bottom wall 93 and by a latch 98*b* to the top wall 92. The bottom wall 93 includes a plurality of aligned keyhole apertures 97 (FIG. 10*d*) for engagement with connector rivets 54 of a linear metal membrane strip unit 40. The top wall 92 is hinged to one end wall 94 by hinges 98*a* and releasably latched to the other end wall 94 by a latch 98*b*. The top wall 92 also includes at least one handle 99 attached thereto. Preferably, a pair of handles 99 provide for easy handling of the rolled roofing dispenser 90. The roofing felt F can be unrolled from either opposed open side 95 of the rectangular container 91. It should be noted that all metal parts are powder coated for durability and resistance to corrosion.

Figure 11:
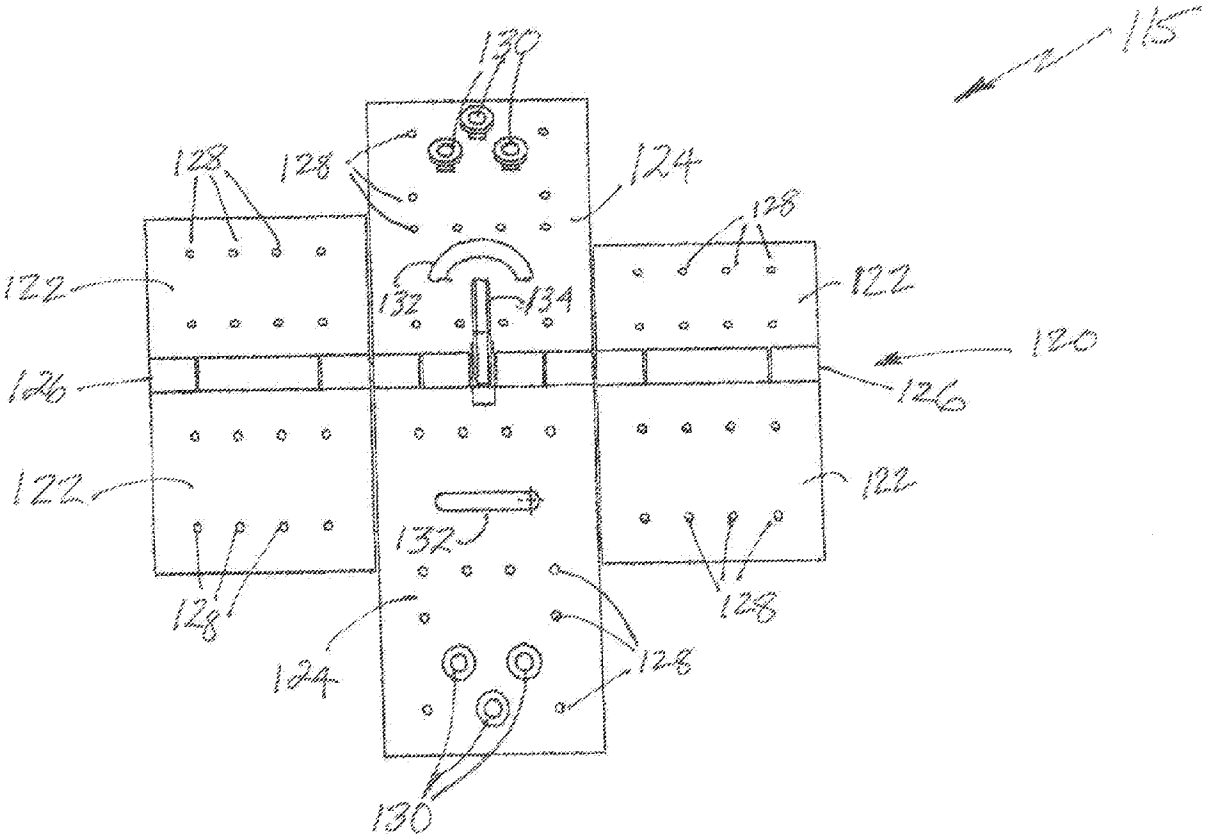
FIG. 11 is a top view of an alternative embodiment of the roof hook member of the present invention.
Figure 12:
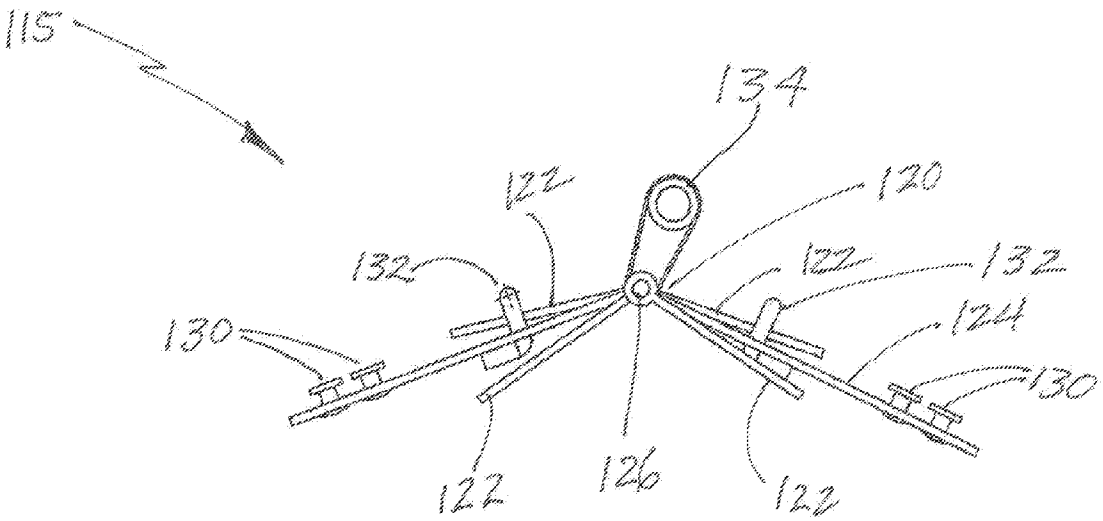
FIG. 12 is a perspective side view of the alternative embodiment of the roof hook member of FIG. 11 of the present invention.

In an alternative embodiment of the invention, the roof scaffolding system 100 for temporary attachment to a roof surface S is illustrated in FIGS. 11-14. FIGS. 11 and 12 show a roof hook member 115 that includes a hinge device 120 having two outer pairs of opposed metal plates 122 and one inner pair of opposed metal plates 124. Each pair of plates 122, 124 is pivotally secured to a common shaft 126 of the hinge device 120, as illustrated in FIG. 11. The two outer pairs of metal plates 122 each have a plurality of attachment apertures 128 therein for securing the hinge device to the roof surface S adjacent the peak P. The inner pair of metal plates 124 each have a plurality of connector rivets 130 extending perpendicularly there from, opposite the common shaft 126. Each metal plate 124 of the inner pair include at least one safety hook 132 secured to the roof hook hinge device 120. An additional safety hook 134 is pivotally secured to the common shaft 126 to provide an additional attachment location for a safety lanyard secured to a workman. The hinge device 120 can accommodate roofs having a wide range of pitch. In this embodiment of the invention, the roof hook member 115 is removably fastened and straddles the peak P of the roof by removable fasteners, such as screws or nails.

Figure 13:
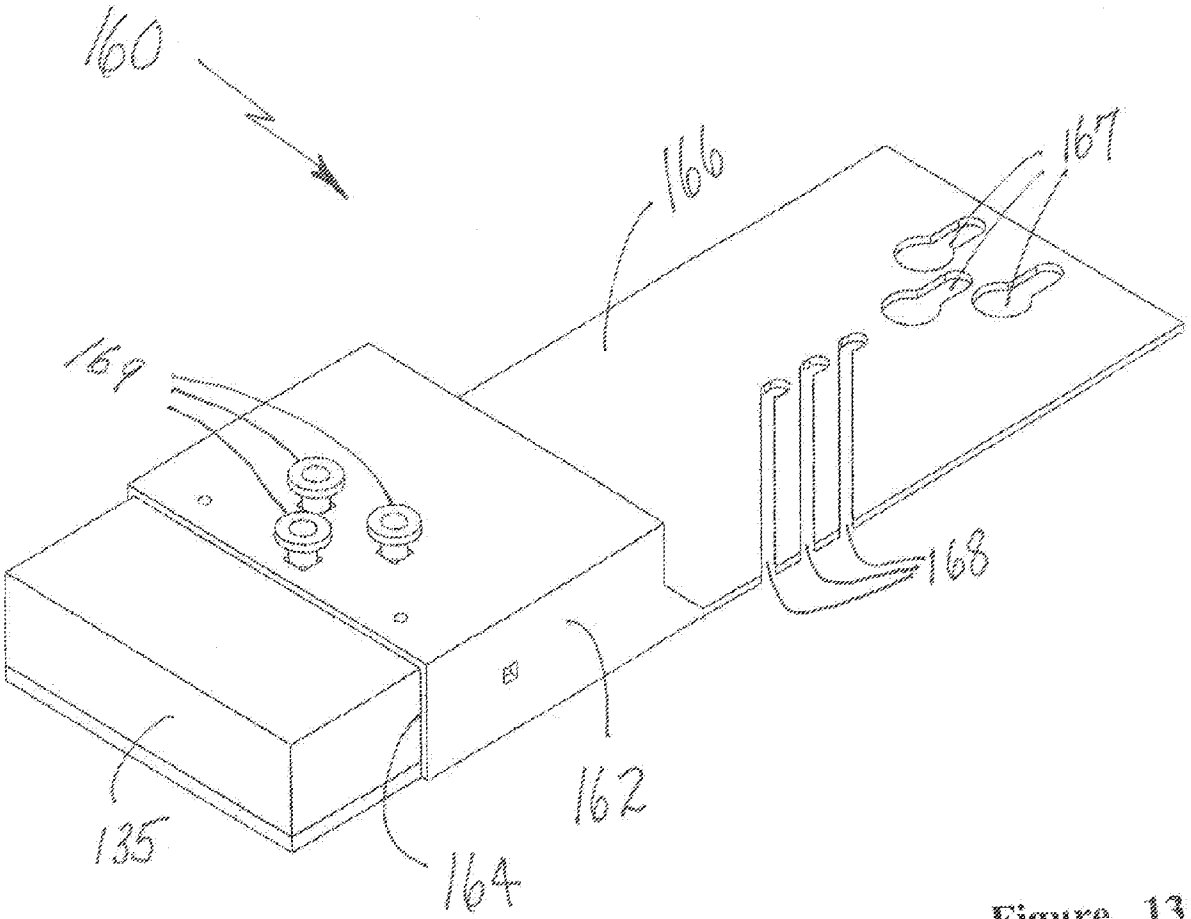
FIG. 13 is a perspective view of the hinge bracket member of the present invention.

In order to attach the roof hook member 115 to a first linear metal membrane strip unit 140, a hinge bracket member 160 is employed. The hinge bracket member 160 includes a hollow, rectangular body 162 with at least one open end 164 and a flange section 166 extending opposite the open end 164 of the rectangular body 162, as illustrated in FIG. 13. The flange section 166 has a plurality of keyhole apertures 167 therein, as well as a plurality of nail slots 168. The keyhole apertures 167 are positioned to engage the plurality of connector rivets 130 of one of the inner pair of metal plates 124 of the hinge device 120. A plurality of connector rivets 130 extend from an exterior surface of the rectangular body 162 of the hinge bracket member 160. An elongated wood block member 135 is secured within the rectangular body 162 of the hinge bracket member 160 and extends opposite the flange section 166 thereof. Only a portion of the elongated wood block member 135 is shown in FIG. 13.

Figure 14:
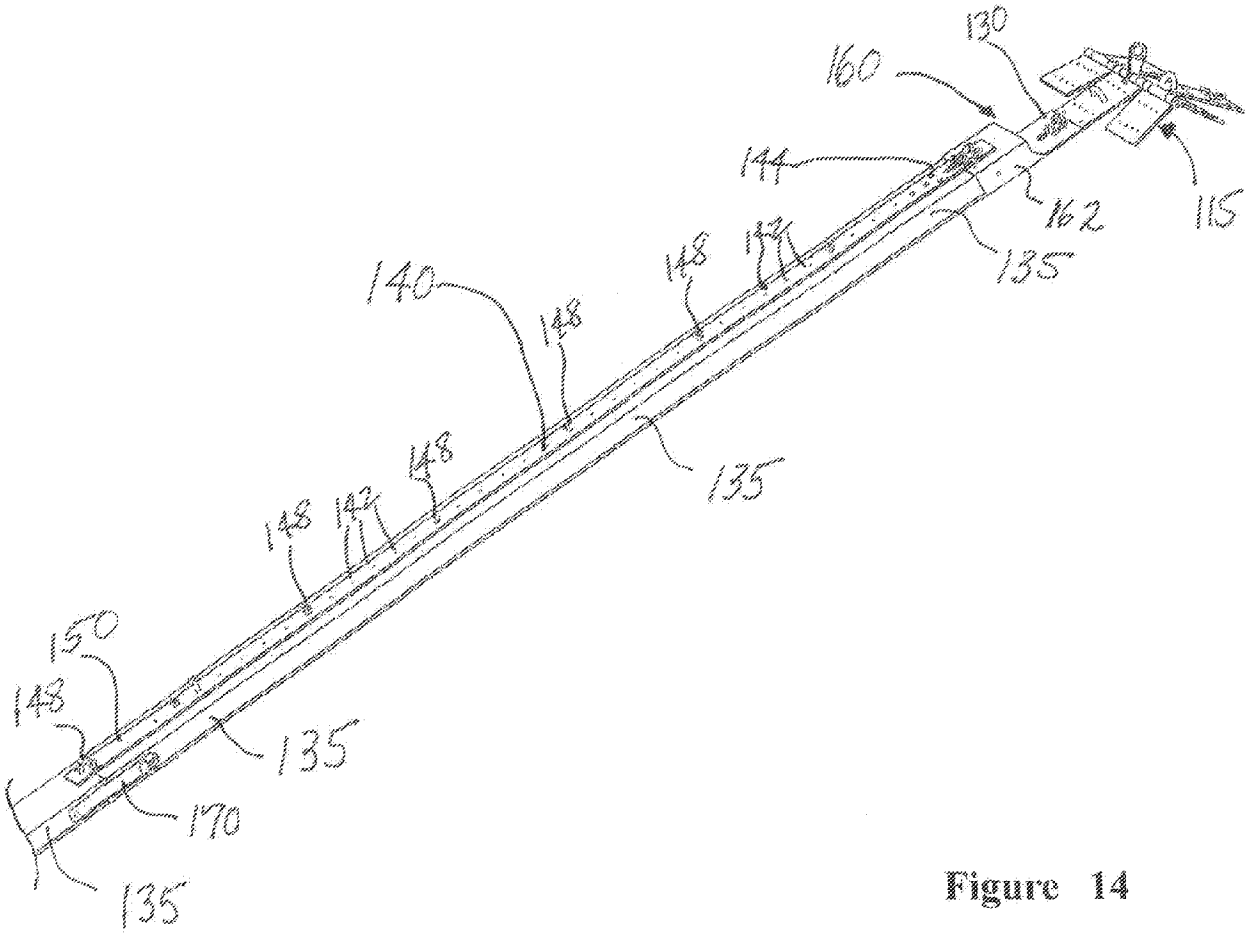
FIG. 14 is a perspective view of the linear metal membrane metal strip units with a hinge bracket member connected to the roof hook member of FIG. 12 of the present invention.

Referring now to FIG. 14, a linear metal membrane strip unit 140 is secured atop the elongated wood block member 135 that extends essentially the length of the strip unit 140. The linear metal membrane strip unit 140 including a plurality of keyhole apertures 146 at a first end 144 thereof and a plurality of connector rivets 148 at a second end 150 thereof. The connector rivets 148 are positioned for engagement with corresponding keyhole apertures 146 in the first end 144 of another linear metal membrane strip unit 140. Again, a plurality of attachment apertures 142 are positioned along the length of the linear metal membrane strip unit 140 for attachment of the elongated wood block member 135 at selected locations there along. As previously described, a plurality of connector rivets 148 extending at spaced intervals from each linear metal membrane strip unit 140 opposite the spacer block member 135. In order to secure the ends of the linear metal membrane strip units 140 together, a coupler system includes pairs of latch plate members 170 connecting the first and second ends of elongated wood block members 135, each wood block member 135 with a linear metal membrane strip unit 140 there upon.

As described previously, a roof jack member 70, shown in FIG. 7, is removably connected to a second end 150 of one linear metal membrane strip unit 140. The roof jack member 70 is adapted for securing a foot board perpendicular to the connected linear metal membrane strip unit 140. The roof jack member 70 is J-shaped with one longer leg section 72 secured to a curved end section 74. The longer leg section 72 includes a plurality of keyhole apertures 76 for securing the roof jack member 70 to the second end 50 of a linear metal membrane strip unit 40 as described earlier. The longer leg section 72 includes a plurality of nail slots 77 and nail apertures 78 therein for fastening a spacer block member 35 thereto, for alignment purposes. The curved end section 74 is adapted for securing a foot board perpendicular thereto, and a safety hook 79 is secured to the roof jack member 70. The safety hook 86 is adapted for engagement with a safety lanyard attached to a workman.

In a further embodiment of the invention, a foot bar member 80 is added to the pair of roof scaffolding systems 100. As illustrated in FIGS. 8 and 9*a*-9*c*, the food bar member 80 comprises a linear angle iron with perpendicular walls 82, each wall 82 including a plurality of keyhole slots 84 adapted for engagement with connector rivets 148 extending at spaced intervals from each linear metal membrane strip unit 140. One wall 82 contains single keyhole slots 84 and the other wall 82 contains double keyhole slots 84 to reduce the weight of the foot bar member 80. In addition, each wall 82 contains attachment apertures 86 for fastening a foot board to either wall 82. Further, a plurality of safety hooks 88 are secured to the foot bar member 80, the safety hooks 88 adapted for engagement with a safety lanyard attached to a workman.

In yet a further embodiment of the invention, a rolled roofing dispenser 90, shown in FIGS. 10*a*-10*d*, is removably secured to one of the linear metal membrane strip units 140. The rolled roofing dispenser 90 comprises a rectangular container 91 with solid top wall 92, bottom wall 93, opposed end walls 94, and opposed open sides 95. A cylindrical support 96 is permanently mounted to one of the opposed end walls 94 and slidably supported by the opposite end wall 94. The support 96 is adapted for holding a roll of roofing felt F. For example, the cylindrical support 96 is slidably mounted in an aperture in one end wall 94, which is attached by a hinge 98*c* to the bottom wall 93 and by a latch 98*b* to the top wall 92. The bottom wall 93 includes a plurality of aligned keyhole apertures 97 (FIG. 10*d*) for engagement with connector rivets 148 of a linear metal membrane strip unit 140. The top wall 92 is hinged to one end wall 94 by hinges 98*a* and releasably latched to the other end wall 94 by a latch 98*b*. The top wall 92 also includes at least one handle 99 attached thereto. Preferably, a pair of handles 99 provide for easy handling of the rolled roofing dispenser 90. The roofing felt F can be unrolled from either opposed open side 95 of the rectangular container 91. It should be noted that all metal parts are powder coated for durability and resistance to corrosion.

Figure 15:
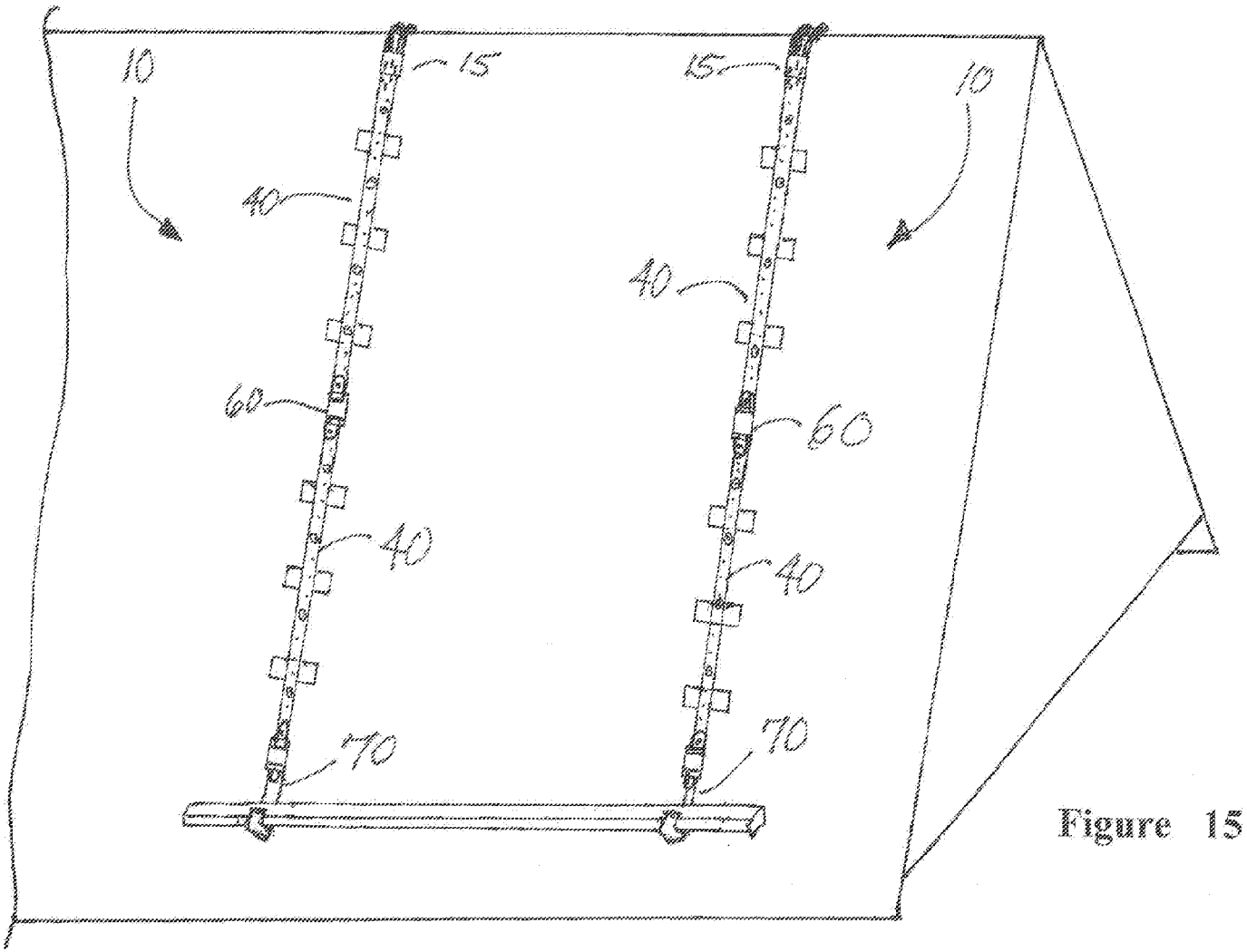
FIG. 15 is a perspective view of a pair of roof scaffolding systems attached to the peak of a roof with a foot board connected between roof jack members.

Referring now to FIG. 15, a pair of roof scaffolding systems 10 is shown with each roof hook member 15 engaged with the peak P of the roof. Each scaffolding system 10 includes two connected linear metal membrane strip units 40 and a roof jack member 70 removably connected to a second end 50 of each linear metal membrane strip unit 40. The roof jack member 70 secures a foot board perpendicular to the connected linear metal membrane strip units 40 of each roof scaffolding system 10.

Figure 16:
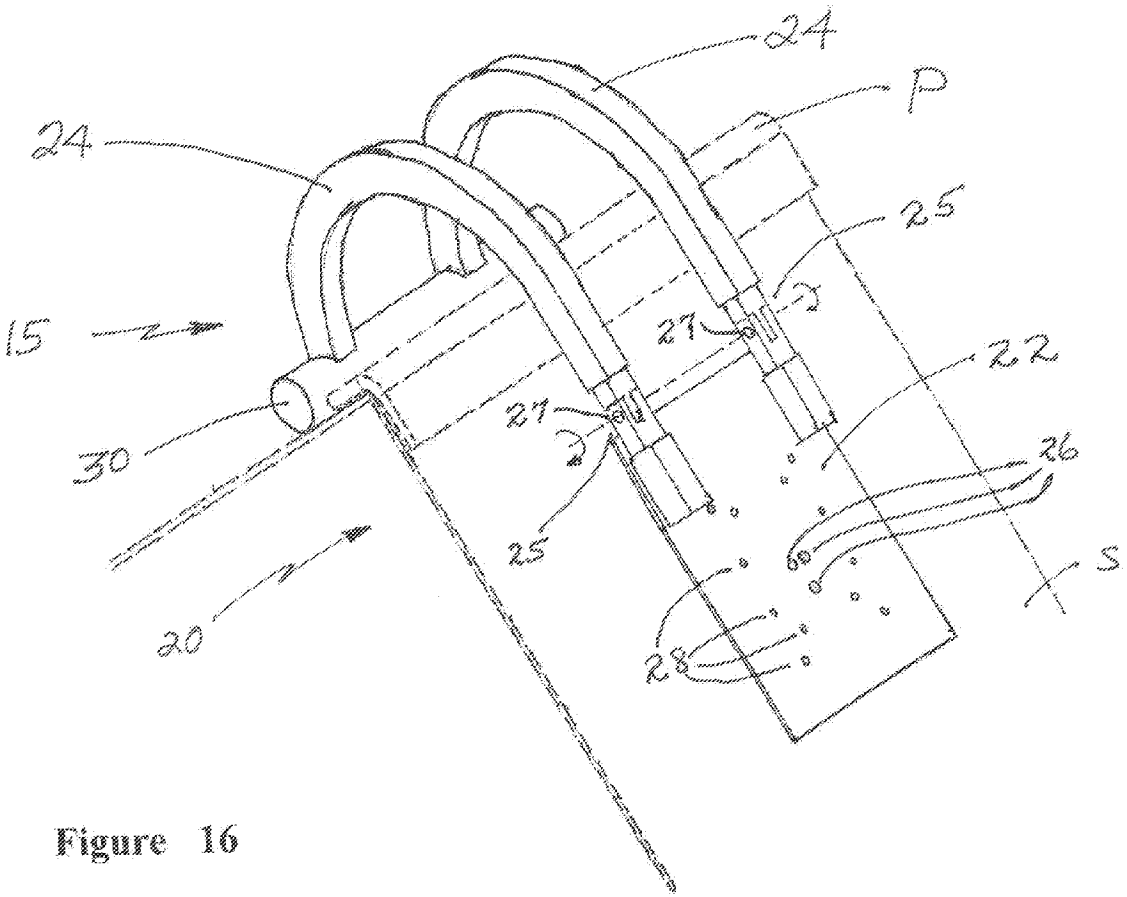
FIG. 16 is a perspective view of a further embodiment of the roof hook member of the present invention with no supporting attachments.

In a further embodiment of the invention, the curved hook end 24 of the roof hook member 15 is pivotally attached to the linear section 22, as illustrated in FIG. 16. In this embodiment, the curved hook end 24 includes a pair of square, hollow tubes secured between the cylindrical section 30 and the linear section 22. A pivoting joint 25 connects each hollow tube to the linear section 22 to selectively vary the angle between the linear section 22 and the curved hook end 24, thereby accommodating a wide range of roof pitches. The pivoting joints 25 each include a locking bolt 27 to maintain the desired orientation between the curved hook end 24 and the linear section 22.

While the invention has been particularly shown and described with reference to preferred embodiments thereof, it will be understood by those skilled in the art that various changes in form and details may be made therein without departing from the spirit and scope of the invention.

We claim:

1. A roof scaffolding system for temporary attachment to a roof surface, the roof scaffolding system comprising:

a roof hook member removably attached to a first end of a first linear metal membrane strip unit having first and second ends, the roof hook member adapted for engagement with the peak of the roof with the first linear metal membrane strip unit extending down the roof;

a second linear metal membrane strip unit having first and second ends, the second strip unit removably attached at the first end thereof to the second end of the first linear metal membrane strip unit opposite the roof hook member;

the first and second linear metal membrane strip units each having at least one connector rivet adjacent each first and second end thereof;

a hollow coupler connector member encircling and locking connected first and second ends of the connected first and second linear metal membrane strip units, the connector member including a pair of sprint-loaded tabs, each tab extending beyond one end of the connector member, each tab including a double keyhole aperture adapted for engaging the a least one connector rivet adjacent one end of a linear metal membrane strip unit, thereby locking the hollow coupler connector member over joined first and second ends of adjacent linear metal membrane strip units;

a roof jack member removably connected to a second end of one linear metal membrane strip unit, the roof jack member adapted for securing a foot board perpendicular to the connected linear metal membrane strip unit; and a plurality of spacer block members rigidly attached along a common side of each of the first and second linear metal membrane strip units and to a common side of the roof jack member, the spacer block members adapted for elevating the attached strip units and roof jack member above the roof surface.

2. The roof scaffolding system of claim 1, wherein the roof hook member includes a J-shaped member with a linear section secured to a curved hook end, the linear section having a plurality of connector studs extending outwardly from a first side thereof, the connector studs engaging the first end of the first linear metal membrane strip unit, with a spacer block member attached to a second side of the linear section of the J-shaped member opposite the connector studs; and the curved hook end having a cylindrical section adapted for contacting the roof surface.

3. The roof scaffolding system of claim 2, wherein the J-shaped roof hook member includes a lockable pivoting joint between the curved hook end and the linear section thereof.

4. The roof scaffolding system of claim 2, wherein the linear metal membrane strip units each include a plurality of apertures at the first end thereof positioned to engage the plurality of connector studs extending outwardly from the first side of the linear section of the J-shaped member, a plurality of keyhole apertures at the first end thereof, a plurality of connector rivets at the second thereof for engagement with corresponding keyhole apertures in the first end of another linear metal membrane strip unit;

a plurality of apertures positioned along the length of the linear metal membrane strip unit for attachment of said spacer block members at selected locations there along; and a plurality of connector rivets extending at spaced intervals from each linear metal membrane strip unit opposite the spacer block members.

5. The roof scaffolding system of claim 1, wherein the roof jack member is J-shaped with one longer leg section secured to a curved end section, the longer leg section including a plurality of keyhole apertures for securing the roof jack member to a linear metal membrane strip unit, and a plurality of nail slots and nail apertures therein;

the curved end section adapted for securing a foot board perpendicular to the roof jack member, and a safety hook secured thereto adapted for engagement with a safety lanyard attached to a workman.

6. The roof scaffolding system of claim 4, further including a rolled roofing dispenser comprising a rectangular container with solid top wall, bottom wall, opposed end walls, and opposed open sides;

a cylindrical support removably mounted between the opposed end walls, the support adapted for holding a roll of roofing felt;

the bottom wall including a plurality of aligned keyhole slots for engagement with connector rivets of a linear metal membrane strip unit; and the top wall hinged to one end wall and releasably latched to the other end wall, the end wall latched to the top wall being hinged to the bottom wall, the top wall including at least one handle attached thereto.

7. A roof scaffolding system for temporary attachment to a roof surface, the roof scaffolding system comprising:

a roof hook member removably attached to a first end of a first linear metal membrane strip unit having first and second ends, the roof hook member adapted for engagement with the peak of the roof with the first linear metal membrane strip unit extending down the roof;

the roof hook member including a J-shaped member with a linear section secured to a curved hook end, the linear section having a plurality of connector studs extending outwardly from a first side thereof, the connector studs engaging the first end of the first linear metal membrane strip unit, with a spacer block member attached to a second side of the linear section of the J-shaped member opposite the connector studs, the curved hook end having a cylindrical section adapted for contacting the roof surface;

the linear metal membrane strip unit including a plurality of apertures at the first end there of positioned to engage the plurality of connector studs extending from the first side of the linear section of the J-shaped roof hook member, the strip unit including a plurality of keyhole apertures at the first end thereof, and a plurality of connector rivets at the second end thereof for engagement with corresponding keyhole apertures in a first end of another linear metal membrane strip unit;

a plurality of apertures positioned at selected locations along the length of the linear metal membrane strip unit;

a plurality of connector rivets extending at spaced intervals along the linear metal membrane strip unit from a common side thereof;

a second linear metal membrane strip unit identical to the first linear metal membrane strip unit including a plurality of apertures and a plurality of connector rivets, the second strip unit removably attached at a first end thereof to the second end of the first linear metal membrane strip unit opposite the roof hook member;

a hollow coupler connector member encircling and locking first and second connected ends of connected first and second linear metal membrane strip units, the hollow coupler connector member including a pair of spring-loaded tabs, each tab extending beyond one end thereof, each tab including a double keyhole aperture adapted for engaging a connector rivet of one linear metal membrane strip unit for locking the hollow coupler connector member over joined ends of adjacent linear metal membrane strip units;

a roof jack member removably connected to a second end of one linear metal membrane strip unit, the roof jack member adapted for securing a foot board perpendicular to the connected linear metal membrane strip unit; and a plurality of spacer block members rigidly attached along a common side of each of the first and second linear metal membrane strip units opposite the plurality of connector rivets and to a common side of the roof jack member, the spacer block members adapted for elevating the attached strip units and roof jack member above the roof surface.

8. The roof scaffolding system of claim 7, wherein the J-shaped roof hook member includes a lockable pivoting joint between the curved hook end and the linear section thereof.

9. The roof scaffolding system of claim 7, wherein the roof jack member is J-shaped with one longer leg section secured to a curved end section, the longer leg section including a plurality of keyhole apertures therein for securing the roof jack member to the connector rivets at the second end of a linear metal membrane strip unit, and the longer leg section having a plurality of nail slots and nail apertures therein; and the curved end section adapted for securing a foot board perpendicular thereto, and a safety hook secured thereto adapted for engagement with a safety lanyard attached to a workman.

10. The roof scaffolding system of claim 7, further including a rolled roofing dispenser comprising a rectangular container with solid top wall, bottom wall, opposed end walls, and opposed open sides;

a cylindrical support removably mounted between the opposed end walls, the support adapted for holding a roll of roofing felt;

the bottom wall including a plurality of aligned keyhole slots for engagement with connector rivets of a linear metal membrane strip unit; and the top wall hinged to one end wall and releasably latched to the other end wall, the end wall attached to the top wall hinged to the bottom wall, the top wall including at least one handle attached thereto.

* * * * *